United States Patent [19]

Patrin

[11] 4,159,566

[45] Jul. 3, 1979

[54] ELECTRIC RAZORCOMB

[76] Inventor: Raymond A. Patrin, GPO Box 731, New York, N.Y. 10001

[21] Appl. No.: 673,817

[22] Filed: Apr. 5, 1976

[51] Int. Cl.[2] ..... B26B 21/12

[52] U.S. Cl. ..... 30/30; 30/220

[58] Field of Search ..... 30/30, 218, 220, 208, 30/215, 216, 31, 74

[56] References Cited

U.S. PATENT DOCUMENTS

| | | | |
|---|---|---|---|
| 657,074 | 9/1900 | Archer | 30/216 |
| 874,932 | 12/1907 | Brigham | 30/30 X |
| 2,083,359 | 6/1937 | Branch | 30/30 X |
| 2,465,694 | 3/1949 | Norwood | 30/30 X |
| 2,718,693 | 9/1955 | Gent | 30/31 |

*Primary Examiner*—Jimmy C. Peters

[57] ABSTRACT

A comb is removably mounted in a multicompartmented housing, a razor moves in a slot in the comb driven by a motion converter transmitter activated by a sinusoid grooved transmission guide mounted on the rotor shaft of the motor, a tie binder is used to close the housing.

12 Claims, 14 Drawing Figures

ELECTRIC RAZORCOMB

I have invented a new and novel electric razorcomb. My razorcomb can be fitted with suitable sized razor and comb attachments in order to cut either human hair or pet hair in styles ranging from the extra short hair cut of the crew cut type to long hair styles. By facilitating hair styling by the individual my razorcomb will save the user enough money in several uses to pay for the unit itself especially where the user has relied on the more expensive hair stylists for preparation of his or her hair or his or her pet hairs. A special tie binder is used in this apparatus but may have applications in other fields. Further features and novel characteristics of this invention will be apparent in view of the description of the invention which follows:

My invention can be understood in view of the accompanying figures.

Figure 10A:
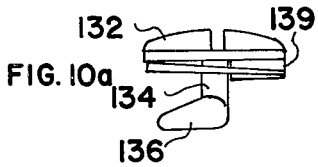
Figure 10B:
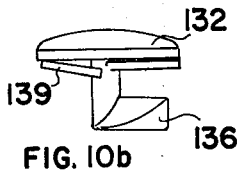
Figure 10C:
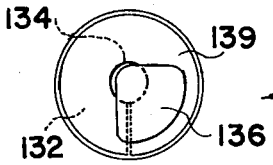

FIG. 10*a, b,* and *c* are perspective views of one of the tie binders.

Figure 10D:
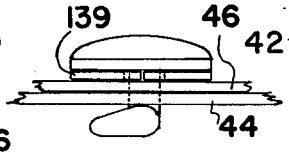

FIG. 10*d* is a detail view of one tie binder in use.

Figure 1:
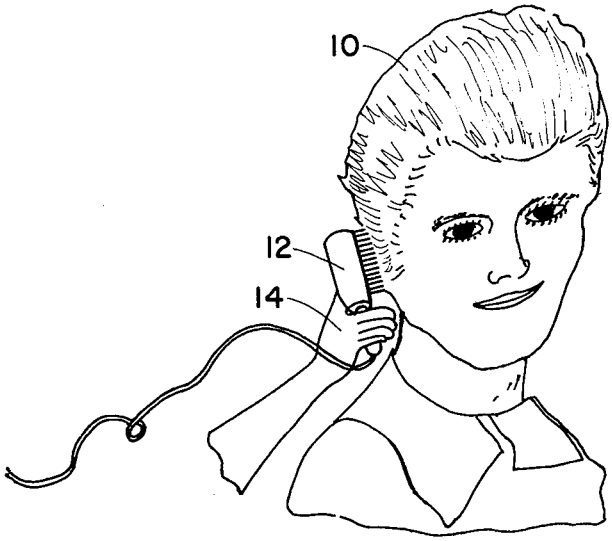
FIG. 1 shows the invention in use whereby a person is engaged in giving himself a haircut.
Figure 11:
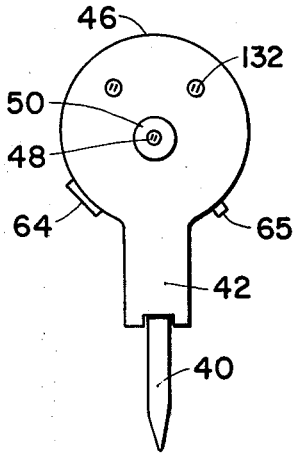

FIG. 11 is a view of the razorcomb of FIG. 1 taken in the plane II—II.

With regard to FIG. 1, a man 10 is using the electric razorcomb 12 on his hair while holding the razorcomb in his hand 14.

With regard to FIGS. 2, 3, 4, 5, 6, 7, 8, 9, 10, and 11, the housing 12 contains a stator 16 and a rotor assembly 18. On the shaft of the rotor assembly a motion transmitting guide 20 is mounted. Motion converters 22 receive their reciprocating motion from the motion transmitting guides 20 and the ends of the rotor assembly are mounted in bearings 24 and 26 which rest against lubricators 28 and 30 in recesses in the housing 12. Motion converter transmitter bases 32 support the pivoting motion converters transmitter 21 22 while spring jams 56 limit the upward motion. Tip of lower end of the motion converters 22 herein called motion transmitter 21, enter slots on an upper edge of the razor 36 while pivot of dual casters 38 are permanently inserted through razor holes 112 and together with the comb 40 attach under the lower section 42 of the housing. The inner sides of lower section 42 of the housing are lined with a vibration absorbing material, such as synthetic cushion layer 116 and 120 covering all sides and contact points with comb 40. Over cushion layers 116, on opposite side of entrance opening for comb 40, magnetic plates 142 are secured to attract in place comb 40 through its magnetic plates 130 on extensions 128. The upper cover 44 and 93 fit over the motor components and a handle which is optional, attached to cover component 46 which in turn in connected to the motor covering components 44 and 93. A line cord 48 enters the cover section 46 protected by cord protecting insulator 50 and the sections of the housing 46 and 44 and 93 are secured together by tie binders and tie 108.

Figure 3:
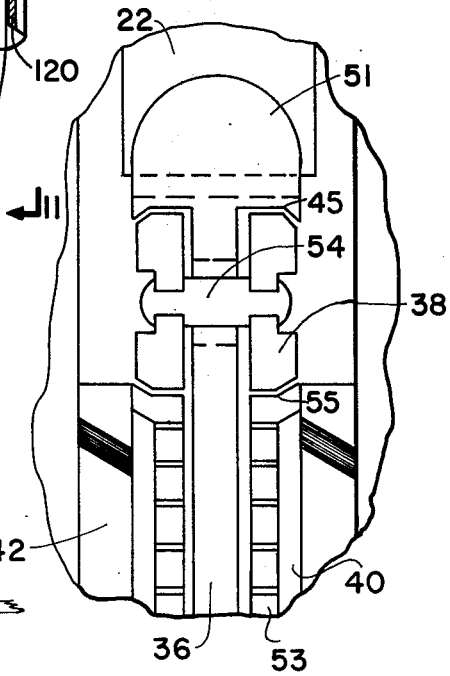
FIG. 3 is the cross section of the razorcomb in a plane perpendicular to the section of FIG. 2 passing through the dual casters.
Figure 9:
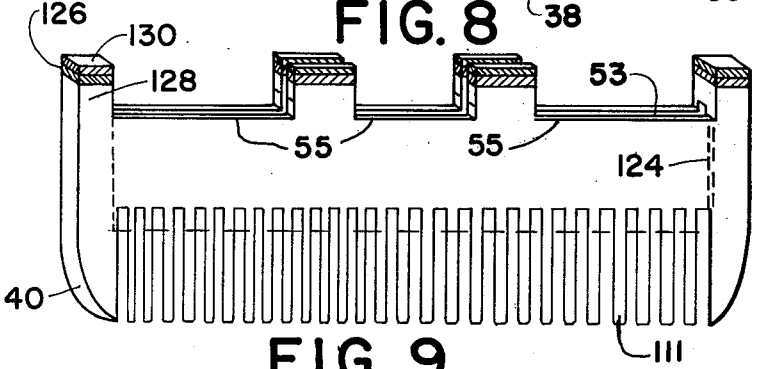
FIG. 9 is a side perspective view of the comb.

In FIGS. 3 and 9, comb 40 can be seen to engulf a slot 124 containing a liner 53, preferrably made of steel, for protection from inserted razor 36. Liner top forms caster guides 55 on both sides of slot entrance, on which dual caster 38 roll or rest. Caster pivots 54 connect the dual casters 38 through holes 112 within the razor 36. Dual casters 38 separate razor 36 from comb 40 as they permit free and independent movement of razor 36 within comb slot 124 by rolling on, and between, razor's angled caster guides 45 and combs counterpart angled caster guides 55.

Figure 4:
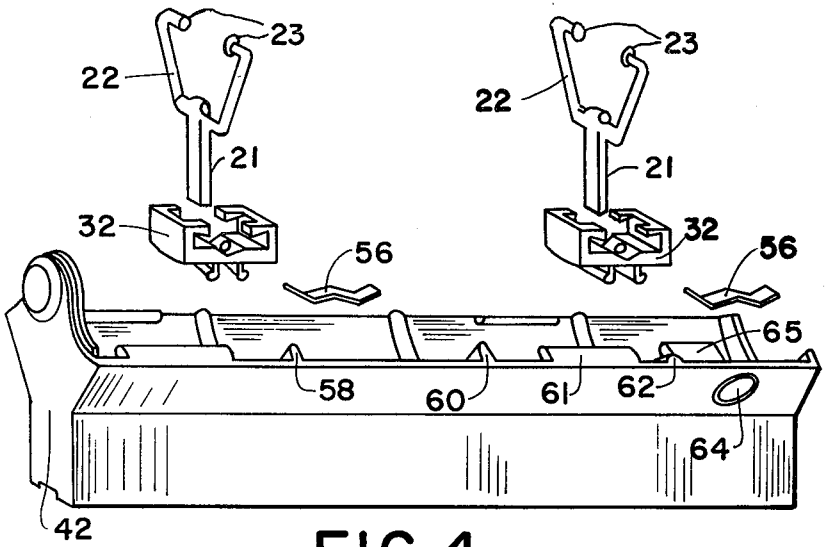
FIG. 4 is a perspective view of the base section of the housing of the electric razorcomb with several of the components seen in exploded view above the bottom section of the housing.

In FIG. 4, inside upper section of housing 42 can be seen to form stator setting rings 58 and 60 a cover locking ledge 61 and a cover support base 62. In the lower housing section 42 are mounted a voltage switch 64 for changing from 115 volts and 60 Hertz to 230 volts at 50 Hertz and an on-off switch 65.

Figure 2:
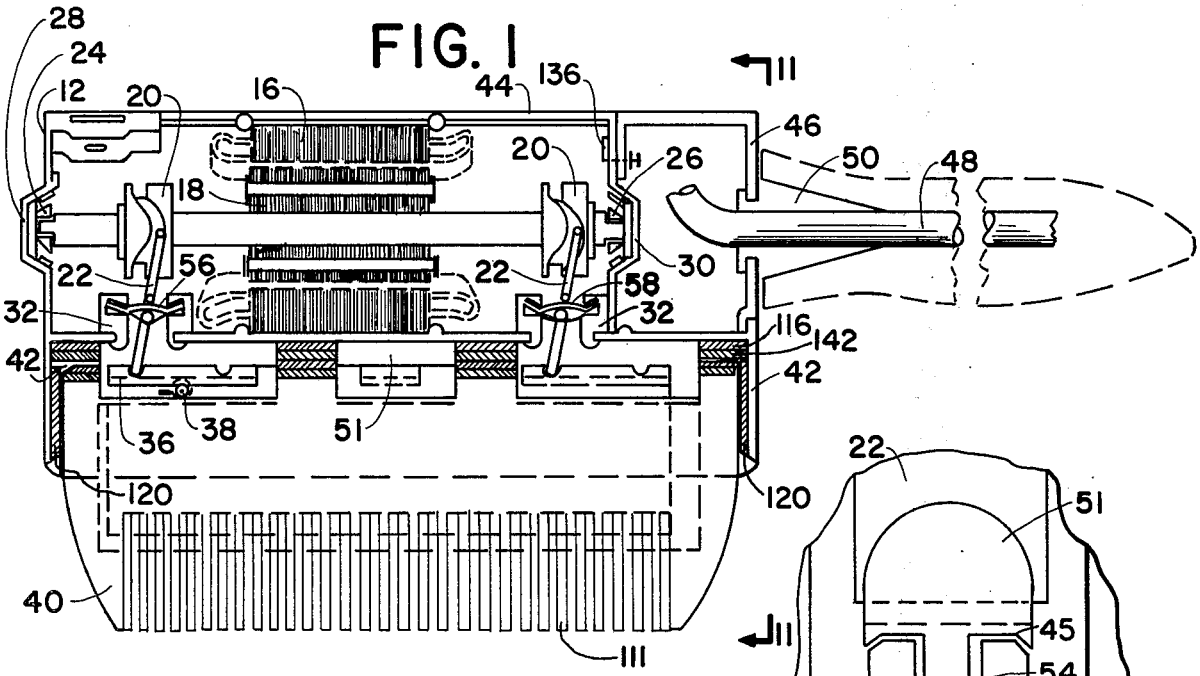
FIG. 2 is a sectional view of the electric razorcomb disclosing the major components.
Figure 5:
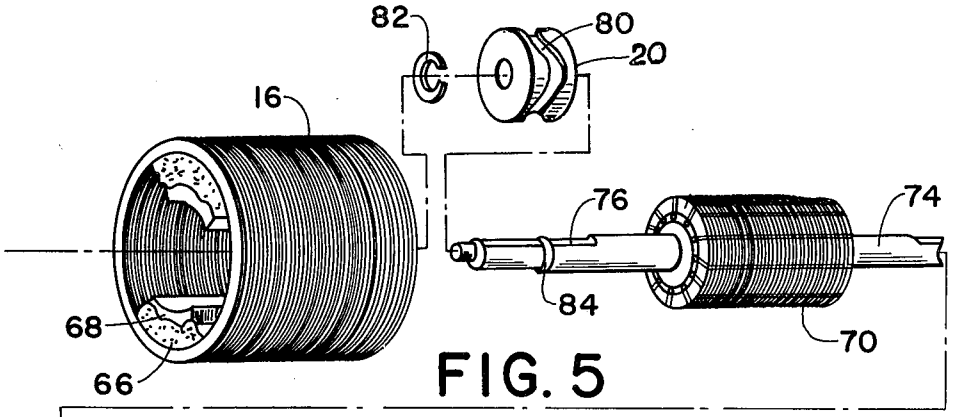
FIG. 5 is an exploded view of the motor.

With particular reference to FIG. 5, the stator 16 contains stator pole coils 66 and shaded poles 68. The rotor assembly 18 of FIG. 2, is seen to comprise a rotor 70 mounted on a shaft 74 which forms a shaft key 76 on which the motion transmitting guides 20 each containing a guide groove 80 to guide the motion receiving roller tips 23 from the motion converters 22 to motion transmitter 21 are mounted. Retaining rings 82 fit in grooves such as 84 after each motion transmitting guide 20 is positioned.

Figure 6:
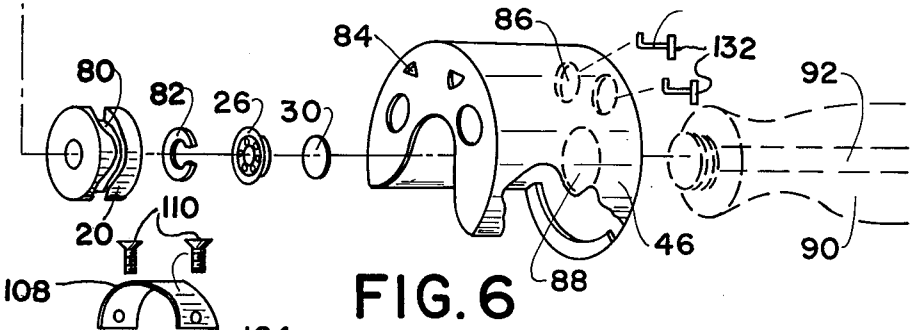
FIG. 6 is an exploded view of other components of the housing and part of the motor support system and of an optional handle.
Figure 7:
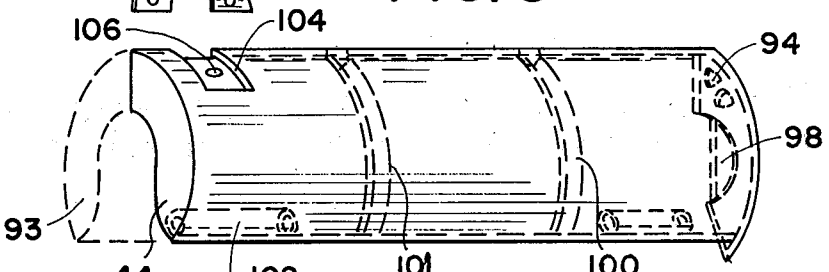
FIG. 7 is a perspective view of two of the upper covered sections.

With particular regard to FIGS. 6 and 7, tie binder mounting holes 84 in cover section 46 can be reached through holes 86 on the rear external surface of the housing section 46 so that tie binders may be mounted through the tie binder mounting holes 84 and 94. The cord hole 88 can receive cord protecting insulator 50 and line cord 48 alone or a handle 90 can be threadingly secured through which the shaftway 92 can accept the line cord 48. The tie binders 52 passing through the tie binder mounting holes 84 twist less than a full turn when passing through to engage the tie binding holes 94 in the motor covering sections of the housing 44 and 93 after the ledge engaging latches 102 have engaged the cover locking ledges 61 of the lower housing section 42. The bearing and lubricator housing recess 98 supports the bearings 24 and 26 and the lubricators 28 and 30. The upper housing sections 44 and 93 form stator setting rings 100 and 101. A tie recess 104 formed in the upper surface of the housing sections 44 and 93 contain screw recesses 106 so that a tie 108 may be received in the recess 104 and can be secured thereto by tie screws 110.

Figure 8:
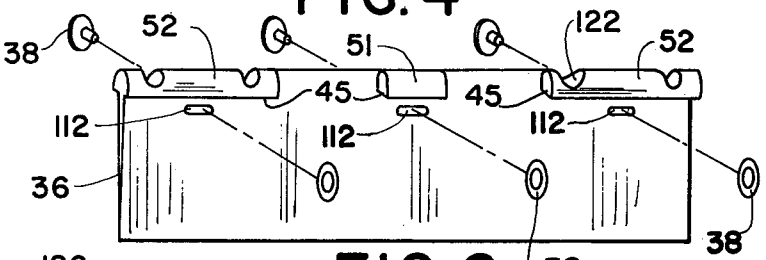
FIG. 8 is a side view of the razor.

With particular reference to FIG. 8, the razor 36 forms pivot slots 112 to receive loosely the dual casters 38 to be guided under caster guides 51 and 52. Caster guides 52 form guide slots 122 to receive tips of motion transmittor 21 extending to the bottom of motion converters 22 to move forth and back due to the rotation of the motion transmitting guide's sinusoid grooves 80 engage to motion receiving roller tips 23 of motion converters 22 causing the razor 36 to moved forth and back by engagement through the tips of motion transmitters 21.

With particular regard to FIG. 9, the upper extensions 128 of the comb 40 a vibration absorbing material such as a synthetic cushion layer 126 is secured on top of which a magnetic plate 130 is secured so that the comb may be magnetically secured within the lower housing section 42. Comb 40 is made to engulf razor slot 124 which is seen to extend below the root line of teeth 111. Razor slot 124 can be of standard depth to receive a standard size razor 36. Combs 40 which ar easily replaced by an outward pull to overcome the magnetic securing means, can be of any desired lengths to accomodate the cutting of extra long to extra short hair of human or of animals.

With particular attention to FIGS. 10 a, b, c and d, the tie binder is seen to comprise a screw head 132 connected by a pivot 134 incorporating a lockwasher such as Belleville spring washer 139 and ending in a spiral edged wedge 136 which can engage the sections of the housing and tighten them as the tie binder is rotated engaging the conical cylinder tip of the spiral edged wedge 136 to rotate against the housing section to be pulled tight in this case section 44 or against section 46.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. An electric razorcomb, comprising:

a housing, a comb removeably secured in the slot of the housing, a slot formed in an inner portion of the comb, a razor mounted in the slot of the comb, said comb secured by magnetic means in the housing and means attached to the housing and connected to the razor to move the razor within the slot in the comb, whereby the razor comb may cut hair from an individual.

2. An electric razor comb, comprising:

a housing, a comb removeably mounted in the housing, a slot formed in an inner portion of the comb, a razor removeably mounted in the housing and insertable in the slot, a stator mounted in the housing, a rotor assembly mounted within the stator and supported by the housing, a transmitting guide secured to a shaft of the rotor assembly to rotate with the shaft, the transmitting guide having a sinusoid guide groove on an outside surface, a motion converter-transmitter ending on two motion receiving roller tips extending opposite one another on a common axis line permitting clearance of separation between them, a roller tip moveably engageable win the guide groove of the motion transmitting guide, a motion converter-transmitter base mounted in the housing and having pivot point receiver to accommodate the motion converter-transmitter, the motion converter-transmitter extending through and pivoted on the motion converter-transmitting base, an upper surface of the razor forming caster guides, caster guide forming an angular bottomed slot, a base of the motion conversion-transmitter fixed in place extending through and secured to the base slot, whereby rotation of the rotor assembly may cause the razor to slidingly move within the housing, and an electrical energy activator means connectable to the rotor to activate the motion converter-transmitter to move the razor in a slot in the razor comb.

3. The electric razorcomb of claim 2, further comprising a spring jam mounted within the motion converter transmittor base, whereby the motion converter transmittor may be spring constrained in its perpendicular motion.

4. The electric razorcomb of claim 3, wherein each end of the rotor assembly is supported in a roller bearing resting against a lubricator mounted in a recess in the housing.

5. The electric razorcomb of claim 4, wherein the rotor assembly comprises shorted copper rods mounted in a rotor, the rotor mounted on the shaft, an end of the shaft forming a bearing bore receiveable in the roller bearing, a length of the shaft proximal to the bearing bore forming a shaft key whereon the transmitting guide may be received, the motion transmitting guide forming a key in a central shaftway of the motion transmitting guide to rotatably secure the motion transmitting guide on the shaft, a groove formed just distal to a location for the motion transmitting guide, and a retaining ring removeably insertable in the groove, whereby the transmitting guide may be lockedly secured in place in a predetermined way.

6. The electric razor comb of claim 5, wherein the stator further comprises: a set of stator pole coils mounted within the stator, and shaded poles mounted within the stator pole coils.

7. The electric razor comb of claim 6, wherein the razor forms a pivot slot for a dual castor, a dual caster having a pivot moving freely in the pivot slot and allowing the dual caster to roll forth and back between the razor caster guides and the caster guides of the comb, whereby the razor may be supported as it moves.

8. The electric razor comb of claim 7, wherein the comb further comprises:

a metal liner inserted in the razor slot, whereby the razor may be prevented from wearing the comb, a proximal end of the comb forming a support base, a synthetic rubber cushion mounted on a proximal end of the support base, and a magnetic flat attached to a proximal end of the synthetic cushion, whereby the comb may be removeably mounted within the housing.

9. The electric razor comb of claim 8, wherein the housing comprises:

a base section, the base section having a razor comb connection section, means of engaging the razor with the rotor section, a cord connecting section mountable on the base section, a plurality of cover sections, means of securing a bottom portion of each of the cover sections to the base section, means of securing a top of each of the cover sections together, and means of securing the cord connecting section to the cover section.

10. The electric comb of claim 9, wherein the means of connecting the sections comprises:

the base forming a cover locking ledge, each of the covers forming a ledge engaging latch whereby the latch may engage the ledge, a central top portion of each of the covers forming a tie recess, a tie secureably attachable in the tie recesses whereby the tops of the cover sections may be connected together, and a tie binder mounting hole formed in a surface of each of the covers adjacent to the cord connecting section corresponding to a pair of tie binder mounting holes formed in the cord connecting section through each of which matched sets of holes a tie binder may be inserted and rotated to tie the sections together.

11. The electric razorcomb of claim 10, wherein a line cord is connected through the cord connection section to the stator and rotor and an optional handle is removeably mounted on the line cord and to the cord connecting section.

12. An electric razorcomb, comprising:

a housing having a comb receiving slot, a comb removeably attached in the housing, by magnetic means securing a portion of the comb in the housing, a slot formed in an inner portion of the comb, a razor removeably mounted in said slot of said comb, and reciprocating means attached inside the housing and connected to the razor to move the razor within the slot in the comb, whereby the razorcomb may cut hair from an individual.

* * * * *